US008443981B1

(12) United States Patent
Eldridge

(10) Patent No.: US 8,443,981 B1
(45) Date of Patent: May 21, 2013

(54) APPARATUS FOR REMOVING HEAVY MATERIAL FROM ORE IN A WATER ENVIRONMENT AND METHOD OF USE

(76) Inventor: Clinton Brent Eldridge, Ely, NV (US)

( * ) Notice: Subject to any disclaimer, the term of this patent is extended or adjusted under 35 U.S.C. 154(b) by 0 days.

(21) Appl. No.: 13/199,710

(22) Filed: Sep. 7, 2011

(51) Int. Cl.
*B07B 9/00* (2006.01)

(52) U.S. Cl.
USPC ..... 209/17; 209/18; 209/155; 209/159; 209/173; 209/175

(58) Field of Classification Search
USPC ..... 209/17, 18, 155, 159, 168, 169, 173, 209/175
See application file for complete search history.

(56) References Cited

U.S. PATENT DOCUMENTS 2,828,015 A * 3/1958 Vissac ..... 209/455
2,857,050 A * 10/1958 Nebel ..... 209/159
3,521,755 A * 7/1970 Bowman ..... 210/520
3,596,765 A * 8/1971 Beudin et al. ..... 209/456
4,772,384 A * 9/1988 Schonert et al. ..... 209/425

* cited by examiner

*Primary Examiner* — Terrell Matthews
(74) *Attorney, Agent, or Firm* — Ted Masters

(57) ABSTRACT

Apparatus for removing heavy material from ore in a water environment includes an upstanding tube, a reservoir, and a pulsator connected between the upstanding tube and the reservoir. The pulsator cyclically causes the upstanding tube to move downward, and fluid pressure within reservoir causes it to move back upward. This vertical pulsation of the upstanding tube effects the separation of heavy material from lighter material contained within the ore. The pulsator includes a member and diaphragm which are cyclically forced downward into the reservoir by a cam-driven rocker arm. A given downward movement of the member and diaphragm results in an amplified upward movement of the ore and the water within the upstanding tube.

21 Claims, 12 Drawing Sheets

20
34C
46
33
22
600, 700
44
38
34D
34A
32
34B
700
40
500
42
93
94
TAP
WATER
92
90
34E

APPARATUS FOR REMOVING HEAVY MATERIAL FROM ORE IN A WATER ENVIRONMENT AND METHOD OF USE

CROSS REFERENCE TO RELATED APPLICATION

None.

TECHNICAL FIELD

The present invention pertains generally to the removal of heavy material from ore in a water environment such as is done in prospecting, and more particularly to a pulsating vertical tube which effects the removal.

BACKGROUND OF THE INVENTION

Gravity separation of ore is well known in the art. In this process heavy material having a greater density is separated from lighter material having lesser density. An apparatus known as a "jig" is one device used to effect the separation. Other devices include tables, spirals, sluices, drywashers, highbankers, cones, screws, cyclones, bowls, and magnetic fields. In the conventional jig, water is mixed with the ore, and the combined mixture is pulsed such as by cyclically surging water upward and downward through the fixed bed of ore. The pulsation is designed to cause lighter particles to rise to the top of the mixture, and the wanted heavier particles to migrate downwardly through the mixture. A screen (grate) combined with ragging (such as steel balls and garnet which are placed on top of the screen) act as a filter which downwardly passes the heavier particles while blocking the lighter particles.

BRIEF SUMMARY OF THE INVENTION

The present invention is directed to an apparatus for removing heavy material from an ore and water mixture. The apparatus separates valuable dense particles, if present, from less dense non-valuable material. As a prospecting tool, a small model of the apparatus can be carried into and used in the field. As a full-size production machine, a large model can be permanently installed in a smaller mill space than can a conventional fixed-bed mineral jig.

In an embodiment, the apparatus comprises a cone-shaped reservoir or hutch, to which are attached legs to elevate the apparatus above a support surface, and a platform upon which is mounted a variable-speed electric motor or internal combustion engine which drives a camshaft through a belt. A rocker arm is mounted on the platform attached to the top of the reservoir. The rocker arm is activated by the camshaft, and pivots to contact and activate an upstanding tube which is mounted vertically on a horizontal diaphragm set within the top of the reservoir. A stanchion and guide are mounted to the side of the reservoir vertically, extending to and encircling the top of the upstanding tube. The stanchion and guide serve to hold the upstanding tube in vertical alignment and limit its upward travel as the upstanding tube cycles vertically. The upstanding tube has at least one screen inside its lower end upon which rests ragging such as steel shot, garnet, or the like for straining heavy material by density. During operation water is continuously circulated through the apparatus by a series of valves and hoses. Feed and discharge tubes are attached to the column to facilitate entry and exit of the material being processed.

In operation the apparatus is set up on a level site with running water available, or water can be hauled in. Due to its small reservoir and low water-flow requirements, re-use/re-circulation of the water through a small receptacle allows for many hours of use with relatively little initial and makeup water. After stabilizing motor speed and water flow, ore is added through the feed tube by hand or with a powered feeder. After the material travels down the feed tube into the upstanding tube, jigging action of the water and concurrent opposite movement of the upstanding tube, causes lighter materials to rise in the upstanding tube and exit via the discharge tube, while heavy materials settle through the bed and screen pursuant to physical realities as disclosed in Stoke's Law of Settling, collecting in the reservoir. A carefully-tuned unit provides very efficient removal of potentially-valuable heavy materials, if present, from the input ore.

The apparatus separates ore to a higher grade concentrate and with a greater recovery than conventional fixed-bed jigs. Its capacity is up- and down-scalable to meet the needs of both the prospector and the mineral producer. A small portable solar-powered version might be constructed to fold into the recreational gold-panner's backpack, potentially outperforming the gold pan in prospecting for or recovery of flour gold or other valuable minerals in remote areas.

In accordance with an embodiment of the invention, apparatus for removing heavy material from ore in a water environment includes an upstanding tube having a top end, an opposite bottom end, a longitudinal axis, and an internal cavity. A screen is disposed across the internal cavity of the upstanding tube, the screen perpendicular to the longitudinal axis of the upstanding tube. A reservoir is disposed beneath the upstanding tube. The ore and water is disposable within the upstanding tube, and the water is disposable within the reservoir. A pulsator is connected to the bottom end of the upstanding tube and to the reservoir. The pulsator causes the upstanding tube to cyclically move downward toward the reservoir thereby causing the ore and water to rise within the upstanding tube.

In accordance with another embodiment, the pulsator includes (1) an outer member connected to the reservoir, (2) a central member connected to the bottom end of the upstanding tube, the central member having an opening which passes the water and the heavy material, and (3) a diaphragm which connects the outer member to the central member. The central member and the diaphragm are movable up and down to create a pulsing action.

In accordance with another embodiment, the outer member, the central member, and the diaphragm are shaped and dimensioned so that a downward vertical movement of the central member and the diaphragm into the water in the reservoir results in a greater upward vertical movement of the ore and the water within the internal cavity of the upstanding tube.

In accordance with another embodiment, the pulsator includes a rocker arm having a head which cyclically forces the central member downward into the reservoir, and pressure in the reservoir urges the central member and the upstanding tube upward.

In accordance with another embodiment, the head of said rocker arm is a yoke which partially surrounds the central member.

In accordance with another embodiment, the rocker arm includes an adjustable roller. A rotating cam engages the adjustable roller on the rocker arm and cyclically forces the rocker arm downward toward the reservoir.

In accordance with another embodiment, the internal cavity of the upstanding tube has a cross sectional area perpendicular to the longitudinal axis. The opening in the central member has a cross sectional area perpendicular to the longitudinal axis, wherein the cross sectional area of the internal cavity is greater than the cross sectional area of the opening in the central member.

In accordance with another embodiment, the central member has an outer radius RF, and the upstanding tube having an inner radius RT. A vertical movement amplification is proportional to RF, and inversely proportional to RT.

In accordance with another embodiment, an adjustable stop stops the upward motion of the upstanding tube.

In accordance with another embodiment, the upstanding tube includes an ore feeder and a tailings discharge. The ore feeder is disposed below the tailings discharge.

In accordance with another embodiment, a stanchion holds the upstanding tube in a vertical orientation. A spring is connected between the stanchion and the upstanding tube, the spring urging the upstanding tube upward.

In accordance with another embodiment, a screen is disposed across the internal cavity of the upstanding tube, the screen not perpendicular to the longitudinal axis of the upstanding tube.

In accordance with another embodiment, the top end of the upstanding tube is open. A threaded rod is shaped and dimensioned to be inserted down from the open top end of the upstanding tube and into the ore and the water.

Other possible embodiments, in addition to the embodiments enumerated above, will become apparent from the following detailed description, taken in conjunction with the accompanying drawings, which illustrate, by way of example, the principles of the apparatus and method of use.

DETAILED DESCRIPTION OF THE INVENTION

Figure 1:
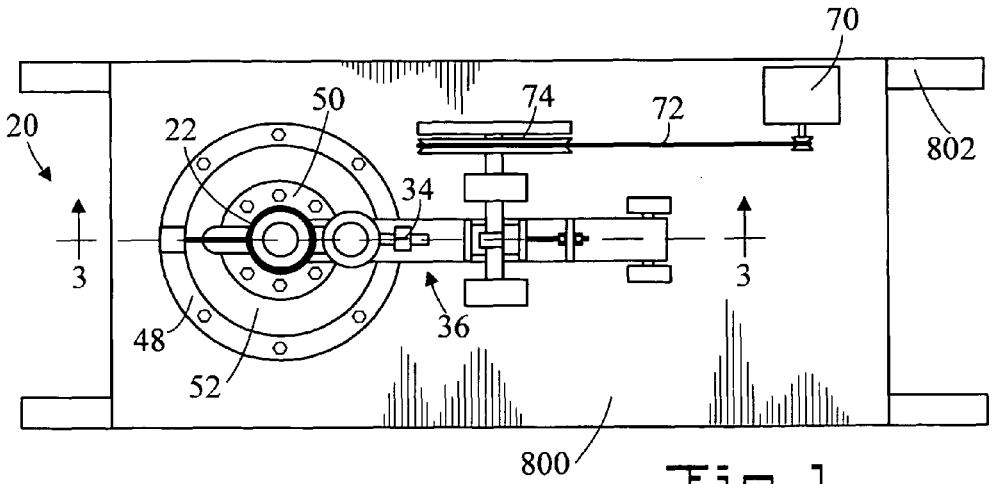
FIG. 1 is a top plan view of apparatus for removing heavy material from ore in a water environment.
Figure 2:
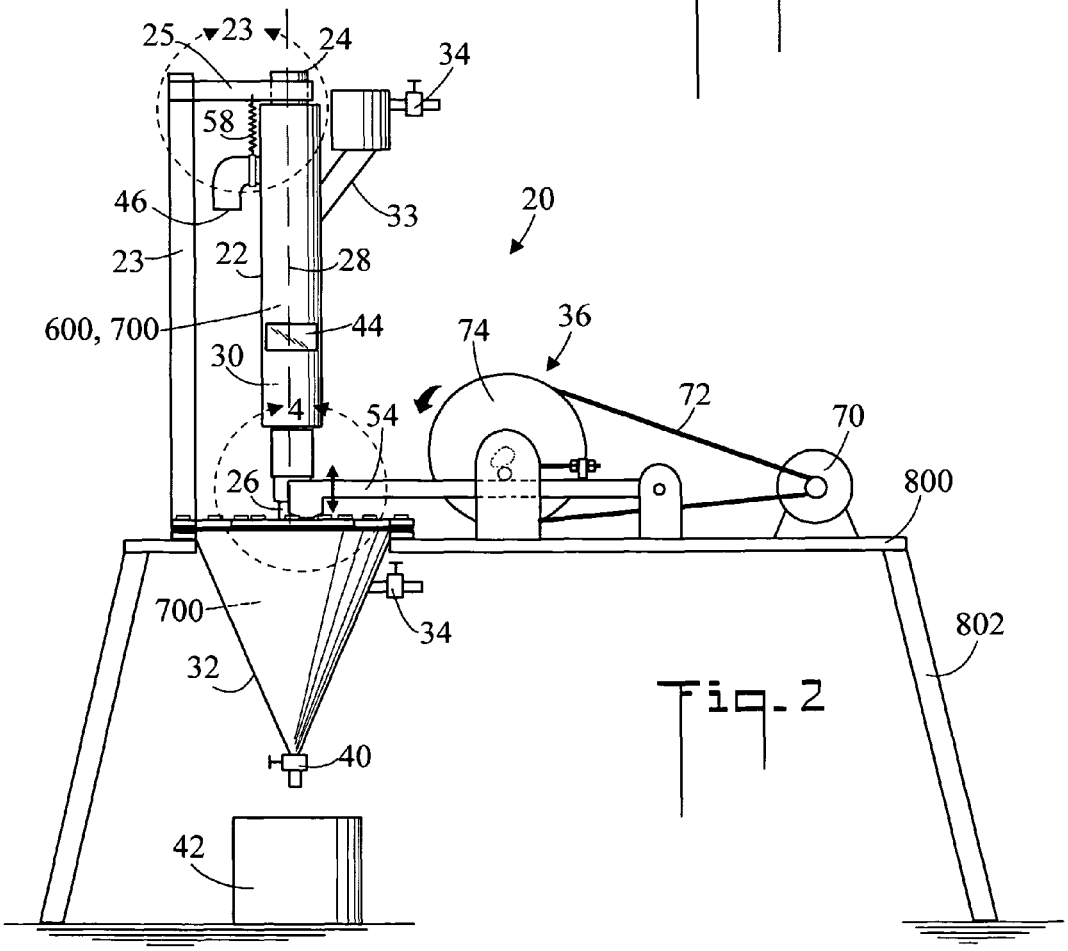
FIG. 2 is a side elevation view of the apparatus.
Figure 3:
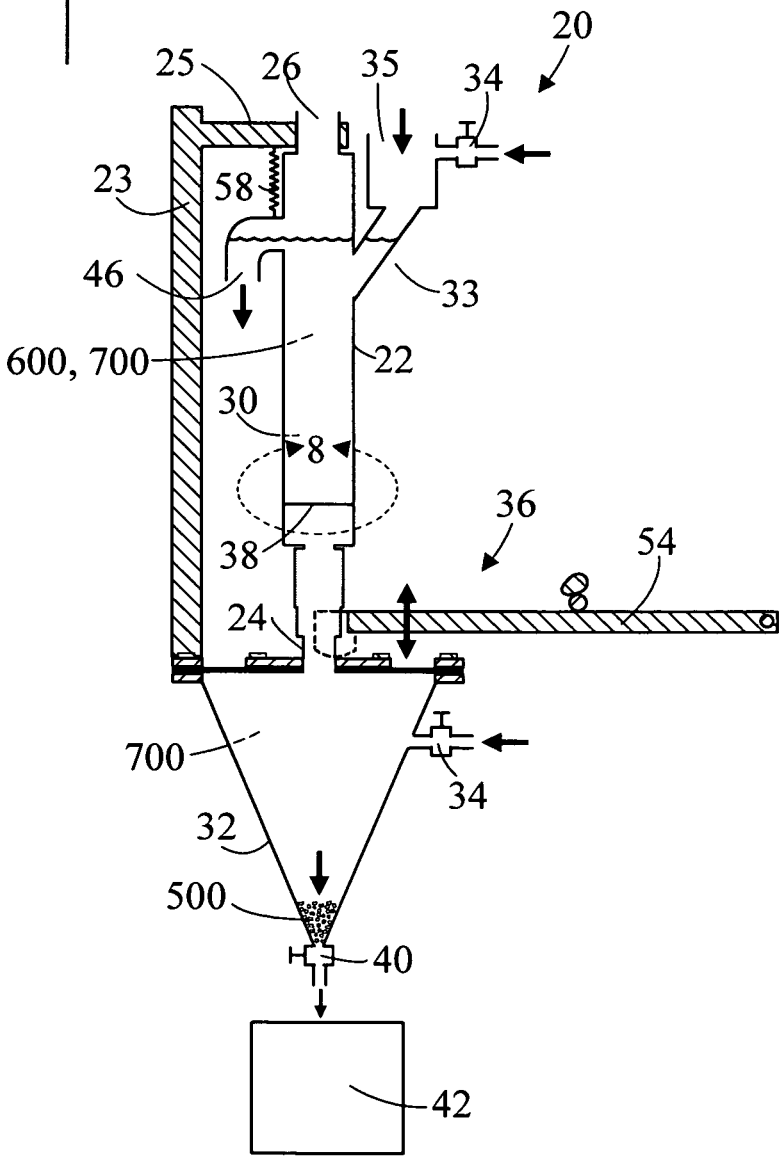
FIG. 3 is a cross sectional view along the line 3-3 of FIG. 1.

Referring initially to FIGS. 1 and 2, there are illustrated top plan and side elevation views respectively of an apparatus for removing heavy material 500 from ore 600 in a water 700 environment, the apparatus generally designated as 20. FIG. 3 is a cross sectional view along the line 3-3 of FIG. 1. As used herein, ore 600 is defined as including both heavy material 500 and lighter material. Apparatus 20 includes an upstanding tube 22 which has a top end 24, an opposite bottom end 26, a longitudinal axis 28, and an internal cavity 30 (also refer to FIG. 8). In an embodiment of apparatus 20, upstanding tube 22 is cylindrical (such as a 3.0 inch internal diameter PVC pipe) and has an open top end 24. A stanchion 23 having an adjustable stop 25 is provided for holding upstanding tube 22 in a vertical orientation (refer also to FIGS. 23 and 24 and the associated discussions). Apparatus 20 further includes a reservoir 32 (also know as a hutch) which is disposed beneath upstanding tube 22. In an embodiment, reservoir 32 has the shape of an inverted cone. Ore 600 (including heavy material 500) and water 700 are disposable within upstanding tube 22. Water 700 is disposable within reservoir 32, and can pass between reservoir 32 and upstanding tube 22. A feed tube 33 and associated hopper 35 for the introduction of ore 600 (which can be pre-screened for size, and hand or automatically fed) into internal cavity 30 is connected near top end 24 of upstanding tube 22, and water 700 is introduced into upstanding tube 22 and reservoir 32 through several valves 34 (also refer to FIG. 26 and the associated discussion). It is noted that before operation ore 600 (including heavy material 500) is disposed in upstanding tube 22 above a screen 28 and ragging, and water 700 is disposed in reservoir 32 (refer to FIG. 8 and the associated discussion). Once the removal process starts, pulsations (see below) and the forces of gravity and hindered settling cause heavy material 500 to pass down through the screen and ragging and into reservoir 32.

A pulsator 36 (refer also to FIGS. 10-14) is connected to bottom end 24 of upstanding tube 22 and to reservoir 32. Pulsator 36 causes upstanding tube 22 to cyclically move downward toward reservoir 32 thereby causing ore 600 and water 700 to rise within upstanding tube 22. That is, the level of ore 600 and water 700 moves up internal cavity 30 of upstanding tube 22 as upstanding tube 22 descends. At the lower extent of downward movement of upstanding tube 22, the fluid pressure of water 700 within reservoir 32 pushes upstanding tube 22 upward as the pulsation cycle recedes (refer to FIGS. 4 and 5 and the related discussions). The fluid pressure in reservoir 32 is caused by the head pressure created by the ore 600 and water 700 in upstanding tube 22. This pulsating action causes the ore 600 and water 700 mixture to move up and down within internal cavity 30 of upstanding tube 22. A screen 38 in conjunction with ragging material (refer to FIG. 8) filters out heavy material 500 which drops via gravity from upstanding tube 22 through reservoir 32 to a heavy material output valve 40 located at the bottom of reservoir 32. The heavy material 500 is collected in a container 42. It is noted that in the shown embodiment the components of apparatus 20 are housed on a platform 800 which has legs 802.

As used herein the term "heavy material" 500 includes minerals whose density is higher than the density of the lighter material components of ore 600. Generally, the specific gravity (SG) of valuable minerals and metals exceeds the SG of the host rock within which they were deposited by nature. Almost all host rock has SG's between 2.5 and 3.0, and valuable minerals and metals in nature have SG's between 3.0 and 21.0. Therefore, the density of the heavy material 500 which apparatus 20 concentrates from ore 600 will generally fall between 1 and 7 times-as-dense as its host rock. Therefore, heavy material 500 can be defined as "material the density of which exceeds that of the host rock within which it was deposited in nature". And, of course, not all heavy material 500, such as iron pyrite or magnetite, is very valuable, so a subsequent process must be undertaken to separate the valuable "heavies" from the nearly-worthless "heavies". It is noted that since apparatus 20 is a gravity separation device, it can't concentrate material of an SG less than or equal to that of the host rock.

Referring to FIG. 1, upstanding tube 22 includes an observation window 44 through which the removal process may be viewed. Observation window 44 allows the apparatus 20 operator to view the pulsations of ore 600 and water 700 (particularly turbulence) and make operational adjustments as required. (also refer to FIGS. 27 and 28 and the associated discussions).

Figure 25:
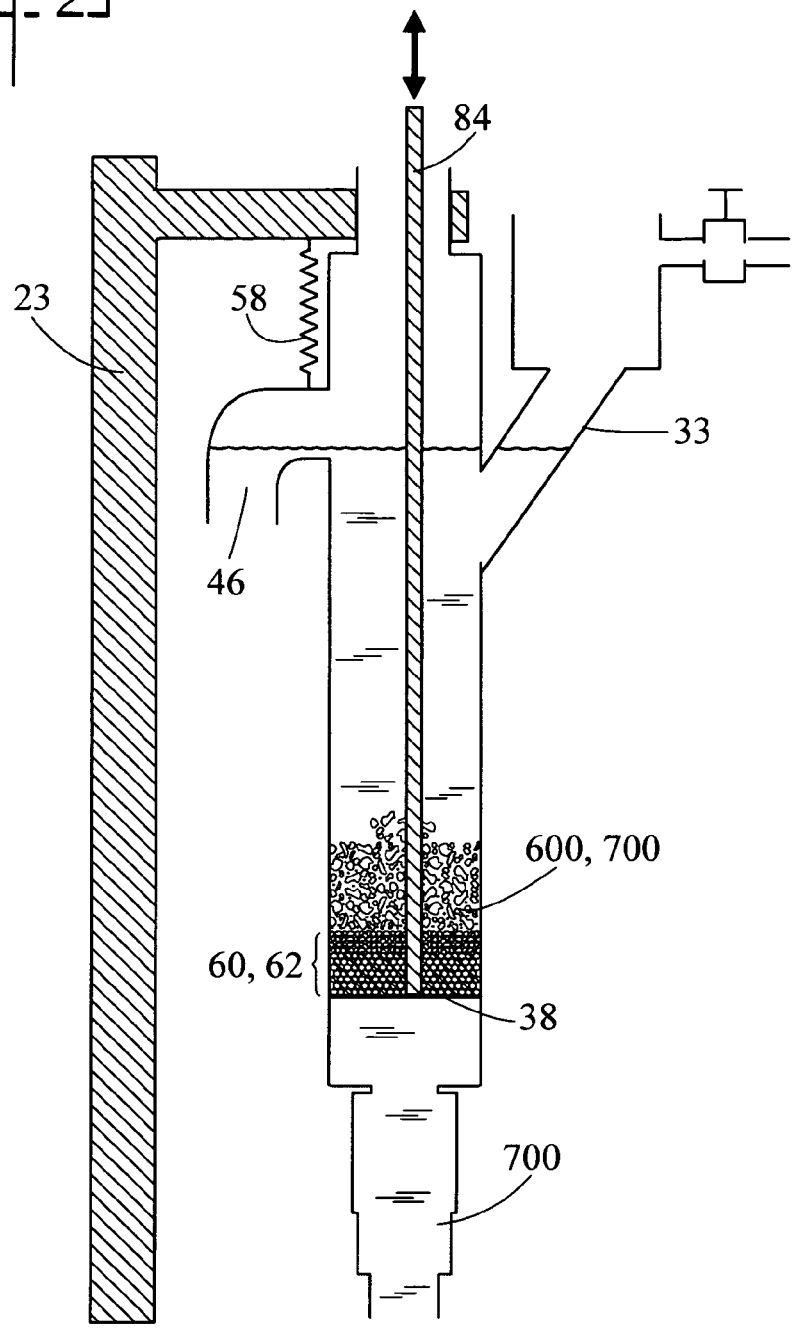
FIG. 25 is cross sectional view of the tube showing measurement of ore pulsations.

Referring to FIG. 3, upstanding tube 22 includes a tailings discharge 46 which carries away water 700 and lighter materials (also refer to FIG. 25). It is noted that ore feeder 33 is disposed below tailings discharge 46 to help assure heavy material 500 settles toward screen 38 rather than bypassing the removal process by flowing directly to tailing discharge 46.

Figure 4:
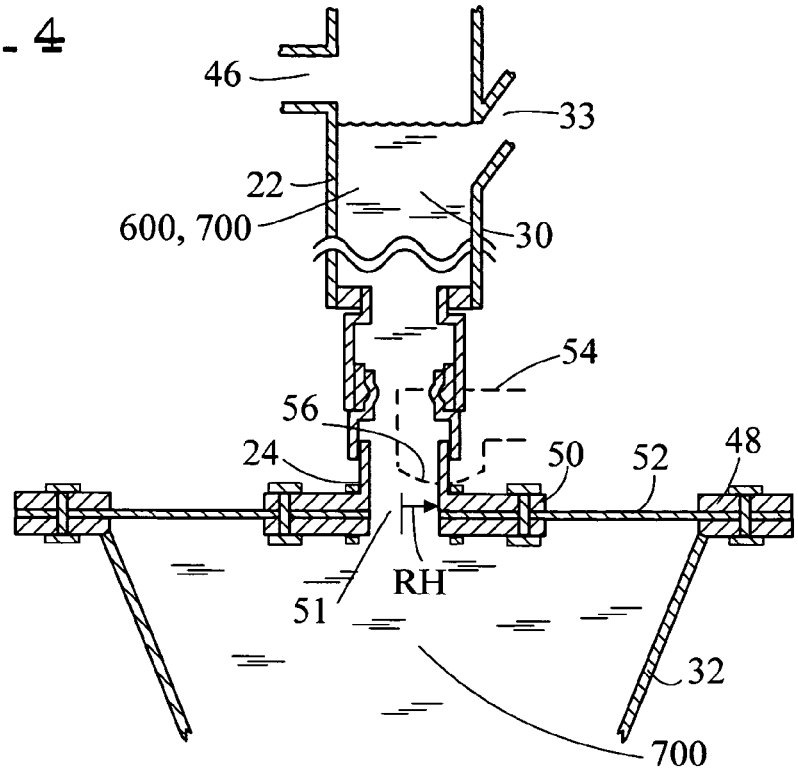
FIG. 4 is an enlarged cross sectional view of area 4 of FIG. 2.
Figure 5:
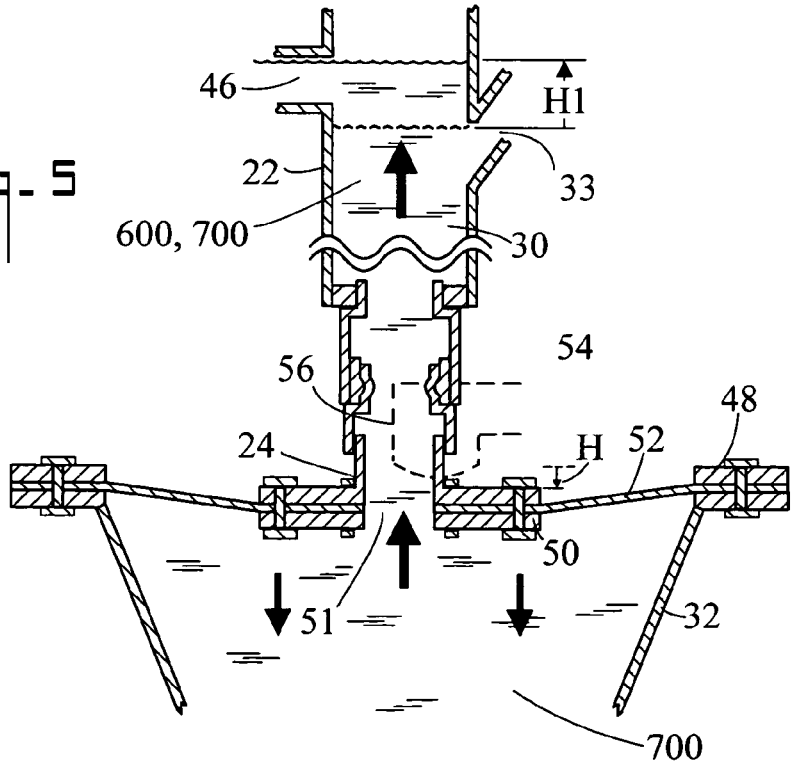
FIG. 5 is an enlarged view showing the downward movement of an upstanding tube.

Now referring to FIGS. 4 and 5, there are shown enlarged cross sectional views which illustrate the downward movement of upstanding tube 22. Pulsator 36 includes (1) an outer member 48 which is connected to reservoir 32, (2) a central member 50 which is connected to bottom end 24 of upstanding tube 22, central member 50 having an opening 51 which passes the water 700 and the heavy material 500, and (3) a diaphragm 52 which connects outer member 48 to central member 50 (also refer to FIG. 1). In an embodiment, diaphragm 52 is fabricated from a flexible rubber covered fabric. Central member 50 and diaphragm 52 are movable up and down to create a pulsing action. FIG. 4 shows central member 50 and diaphragm 52 in an upward position, and FIG. 5 shows central member 50 and diaphragm 52 in a downward position. In the shown embodiment, outer member 48 is a circular ring, and central member 50 is a flange, wherein diaphragm 52 is circular and connected between outer member 48 and central member 50.

Figure 6:
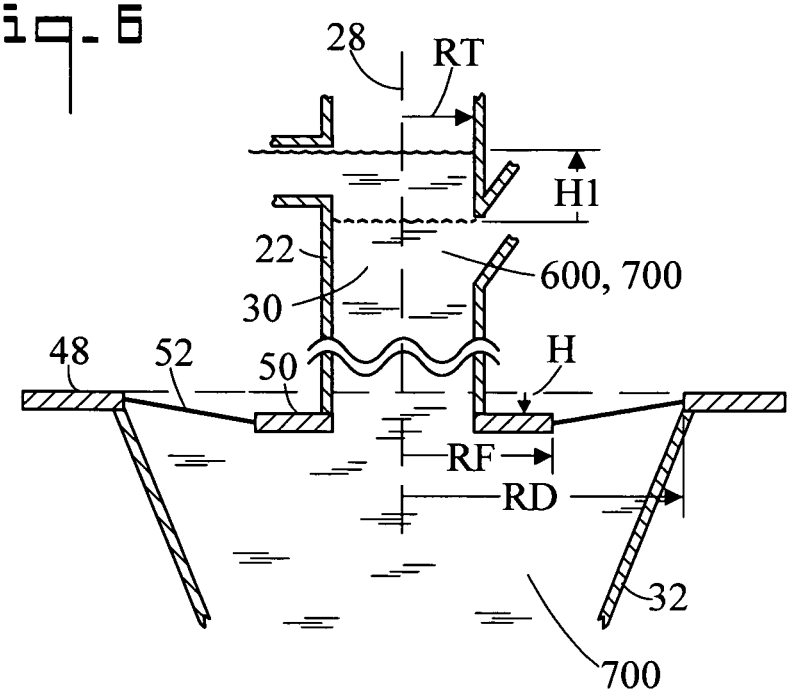
FIG. 6 is an enlarged view showing the principle of vertical movement amplification.

Outer member 48, central member 50, and diaphragm 52 are shaped and dimensioned so that a downward vertical movement H of central member 50 and diaphragm 52 into the water 700 in reservoir 32 results in a greater upward vertical movement H1 of the ore 600 and water 700 within internal cavity 30 of upstanding tube 32. Distance H is the stroke distance. In other words, the upward ore 600 and water 700 movement in upstanding tube 22 is "amplified" with respect to the downward movement of central member 50 and diaphragm 52 into reservoir 32. Referring to FIG. 6, if central member 50 (and attached upstanding tube 22) is moved down a distance H (stroke distance) into reservoir 32, the ore 600 and water 700 level inside upstanding tube 22 will move up a distance H1 where H1 is greater than H. In an embodiment, distance H1 is 3-5 times H (i.e. a distance amplification of between three and five). For example, if H was 0.1875 inches (3/16), H1 would be between 0.5625 inches and 0.9375 inches. The amplification principle is further discussed under FIGS. 6 and 7. In an embodiment, the downward vertical displacement H of central member 50 is between about one-eighth inch (0.125) and about three-eighth inches (0.375).

The pulsating downward motion of central member 50 is effected by a rocker arm 54 which has a head 56 which abuts and cyclically forces central member 50 downward into reservoir 32 (also refer to FIGS. 10-14 and the associated discussions). FIG. 5 shows central member 50 being forced down into reservoir 32. When the downward force on central member 50 is removed, central member 50 and attached upstanding tube 22 are urged upward by fluid pressure in reservoir 32 to the position shown in FIG. 4. The alternating positions of FIGS. 4 and 5 produce the pulsating action of the ore 600 and water 700 in upstanding tube 22. In an embodiment, a supplemental force assists central member 50 and upstanding tube 22 in their upward motion. Referring to FIGS. 1, 3, and 25, a spring 58 is connected between stanchion 23 and upstanding tube 22. Spring 58 urges upstanding tube 22 upward, and therefore assists the pressure in reservoir 32 to return central member 50 and upstanding tube 22 to the nominal position shown in FIG. 4.

In the embodiments shown in FIGS. 4 and 5, the vertical movement amplification or compounding of the water stroke attributable to the downward motion of central member 50 is enhanced by reducing the size of the passage between reservoir 32 and upstanding tube 22. Internal cavity 30 of upstanding tube 22 has a cross sectional area perpendicular to longitudinal axis 28 (refer to FIG. 1). Opening 51 in central member 50 has a cross sectional area perpendicular to longitudinal axis 28. The cross sectional area of internal cavity 30 is greater than the cross sectional area of opening 51 in central member 50. That is, opening 51 in central member 50 has a smaller diameter than the inside diameter of upstanding tube 22, causing a necking-down effect. This diameter reduction results in increased momentum added to the center of the upward flow of the ore 600 and water 700 during the downward stroke of central member 50. This centered momentum somewhat reduces the turbulence along the inside wall of upstanding tube 22, and helps avoid losing heavy material 500 through ore and water discharge 46. In the shown embodiment, upstanding tube 22 is removably connected to central member 50 by a camlock connector (similar to a fire hose connector) so that the two can be conveniently separated for transport and storage.

Figure 7:
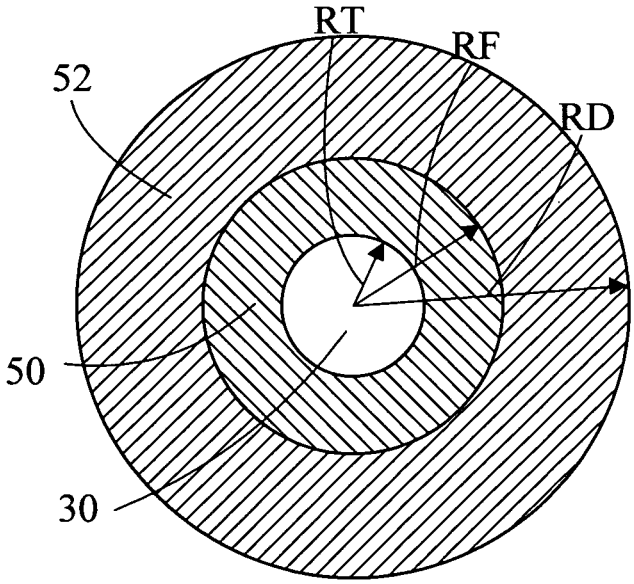
FIG. 7 is a diagram which illustrates the vertical movement amplification.

FIG. 6 is an enlarged view showing the principle of vertical movement amplification, and FIG. 7 is a diagram which illustrates the vertical movement amplification. It is noted that for simplicity in FIG. 6, internal cavity 30 of upstanding tube 22 opens directly into reservoir 32 without any necking down. When central member 50 is forced down a distance H (stroke distance), central member 50 and diaphragm 52 displace a volume of water 700 from reservoir 32. This displaced volume moves up a distance H1 in internal cavity 30 of upstanding tube 22, wherein H1 is greater than H (vertical movement amplification).

The relationship of H1 divided by H (the vertical movement amplification) is seen to be proportional to the outer radius RF of central member 50, and inversely proportional to the inner radius RT of upstanding tube 22. By selecting appropriate values of RF and RT a desired vertical movement amplification can be achieved. That is, (1) as the size of central member 50 increases, the volume of water 700 displaced from reservoir 32 will also increase, and (2) as the size of upstanding tube 22 increases, the displaced water 700 will travel a lesser upward distance H1. It is also noted that the size of diaphragm 52 can also affect the vertical movement amplification. In general, and depending upon the exact diaphragm 52 configuration and physical properties, a larger diaphragm 52 will result in a larger vertical movement amplification.

Figure 8:
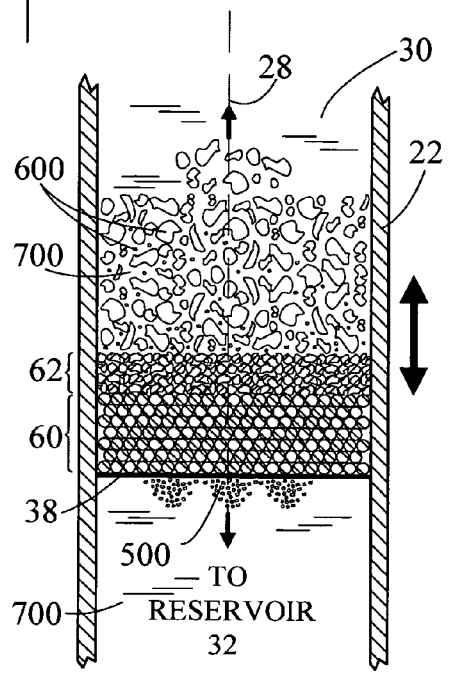
FIG. 8 is an enlarged cross sectional view of area 8 of FIG. 3.

FIG. 8 is an enlarged cross sectional view of area 8 of FIG. 3 showing ore 600 and water 700 inside upstanding tube 22. Ore 600 and water 700 is filtered by screen 38 which is disposed perpendicular to longitudinal axis 28 of upstanding tube 22. Screen 38 is a mesh having openings of a desired size. In the shown embodiment, the ore filtering is enhanced by a layer of steel balls 60 disposed on top of screen 38, and a layer of heavy mineral 62 (such as garnet) which is disposed on top of steel balls 60. Steel balls 60 and heavy mineral 62 combine to form what is called "ragging". The size of the openings in screen 38, the size of steel balls 60, and the size of heavy mineral 62 are all selected consistent with the particle size and density of the ore 600 which is being processed. Ore 600 and water 700 stratify above ragging (60, 62) and screen 38, and the up and down motion of upstanding tube 22 causes ore 600 to separate, wherein heavy materials 500 pass through the ragging (also known as the bed) and screen 38 and into reservoir 32, and lighter materials are washed away through tailings discharge 46 (refer to FIGS. 3-5). As such, the ore 600 particles below screen 38 consists primarily of heavy material 500, and the ore 600 particles above screen 38 consist of both heavy material 500 and light material.

Figure 9:
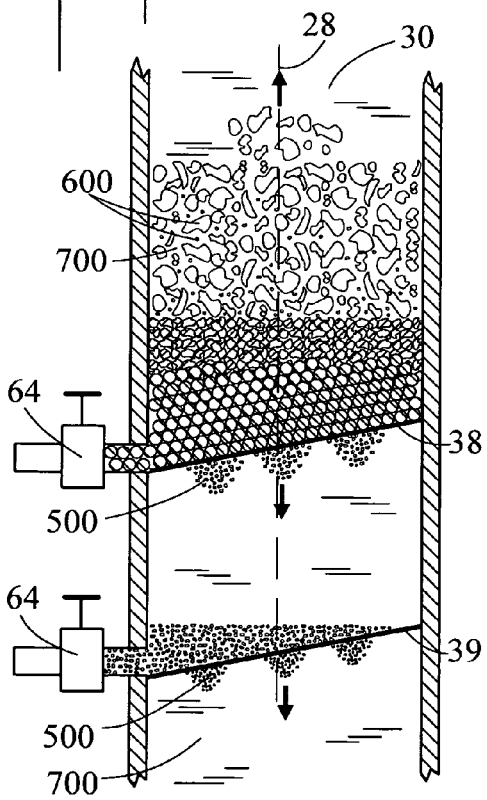
FIG. 9 is enlarged cross sectional view of a second embodiment of a screen and ragging.

FIG. 9 is enlarged cross sectional view of a second embodiment of screen 38 and ragging. In this embodiment, screen 38 is disposed across internal cavity 30 of upstanding tube 22, however screen 38 is slightly angled and not perpendicular to longitudinal axis 28 of upstanding tube 22. In the shown embodiment two screens 38 and 39 are employed wherein lower screen 39 has smaller holes than upper screen 38, providing a method for tapping off larger concentrate heavy material 500 through valve 64. The slight angling of screens 38 and 39 better causes larger material to flow toward bleed valves 64 to be periodically tapped off or to empty and clean upstanding tube 22.

Figure 10:
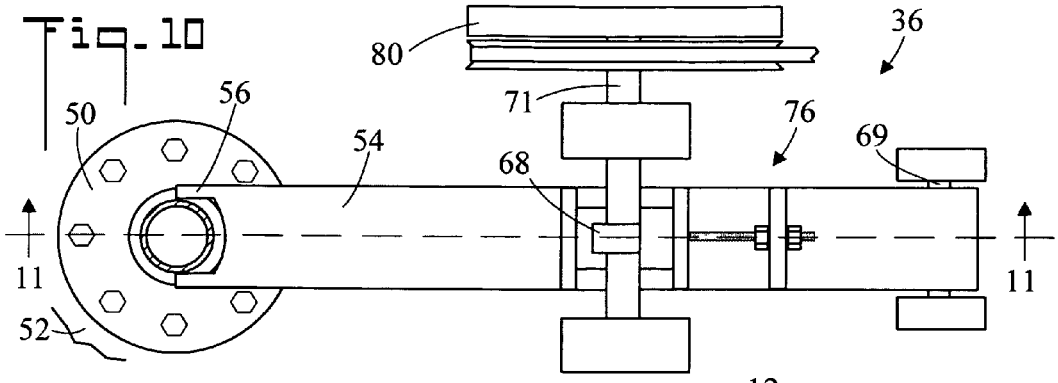
FIG. 10 is an enlarged top plan view of the pulsator.
Figure 11:
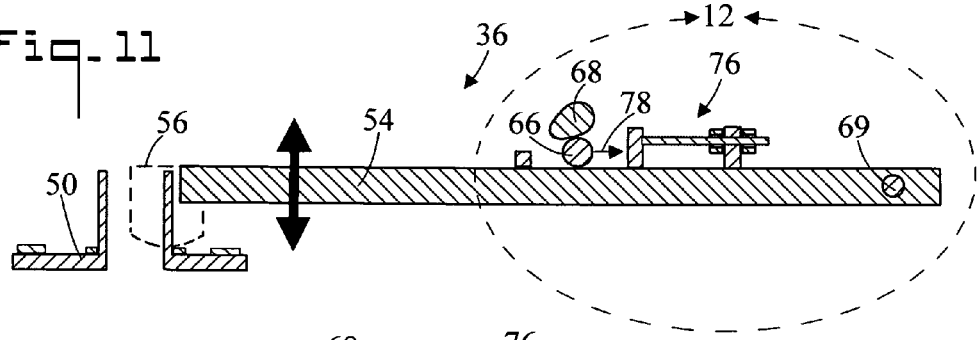
FIG. 11 is a cross sectional view along the line 11-11 of FIG. 10.

FIG. 10 is an enlarged top plan view of pulsator 36, and FIG. 11 is a cross sectional view along the line 11-11 of FIG. 10. Pulsator 36 includes rocker arm 54 which has head 56 which cyclically forces central member 50 (and attached upstanding tube 22) downward into reservoir 32 (refer also to FIG. 5). Rocker arm 54 rotates about pivot 69 and includes an adjustable roller 66. A rotating cam 68 engages adjustable roller 66 on rocker arm 54 and cyclically forces head 56 of rocker arm 54 downward toward reservoir 32 (refer to FIG. 5). Referring also to FIGS. 1 and 2, the rotation of rotating cam 68 is effected by a motor 70, V belt 72, and pulley 74 arrangement. In the shown embodiment, motor 70 is a variable speed motor. FIG. 11 shows rotating cam 68 just starting to force adjustable roller 66 downward. In an embodiment, rotating cam 68 rotates between about 120 rpm and about 150 rpm. In another embodiment, motor 70 (refer to FIGS. 1 and 2) has a speed adjustment which can be used to adjust the pulsation rpm.

Figure 12:
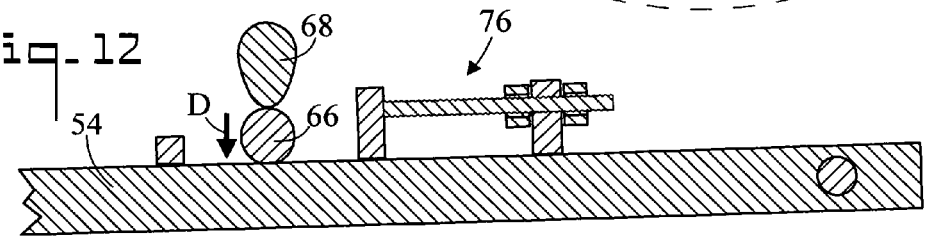
FIG. 12 is an enlarged view of area 12-12 of FIG. 11.
Figure 13:
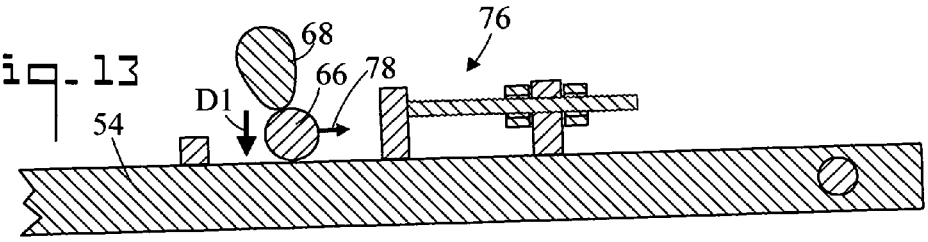
FIG. 13 is an enlarged view of as in FIG. 12 with the pulsator adjusted for a longer stroke.
Figure 14:
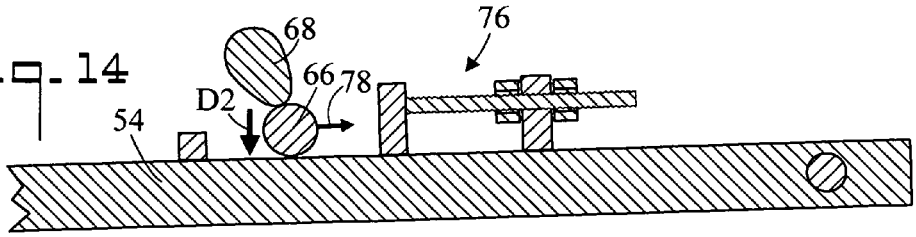
FIG. 14 is an enlarged view as in FIG. 12 with the pulsator adjusted for an even longer stroke.

FIG. 12 is an enlarged view of area 12-12 of FIG. 11, FIG. 13 is an enlarged view of as in FIG. 12 with pulsator 36 adjusted for a longer stroke (H, refer to FIGS. 4-6), and FIG. 14 is an enlarged view as in FIG. 12 with pulsator 36 adjusted for an even longer stroke. A screw assembly 76 (also refer to FIG. 28) allows the position of adjustable roller 66 to be longitudinally moved along rocker arm 54 in direction 78 or 79. In FIG. 12, rotating cam 68 pushes adjustable roller 66 down a distance D which causes head 56 of rocker arm 54 to depress central member 50 a given distance (stroke distance H). It may be appreciated that the stroke distance H (refer to FIGS. 4-6) is a function of the vertical distance D which adjustable roller 66 moves. In FIG. 13, adjustable roller 66 has been moved by screw assembly in direction 78. As such rotating cam 68 has more effect on adjustable roller 66 and depresses adjustable roller 66 a distance D1 which is more than distance D of FIG. 13. Therefore the downward stroke of head 56 of rocker arm 54 is lengthened. Similarly in FIG. 14, adjustable roller 66 has been moved by screw assembly 76 further in direction 78 causing adjustable roller 66 to be depressed an even greater distance D2, and lengthening the downward stroke of head 56 of rocker arm 54 even more. The progressive lengthening of the downward stroke shown in FIGS. 12-14 is further illustrated and discussed below in FIGS. 15-20.

The length and frequency of the stroke of head 56 of rocker arm 54 are adjustable to accommodate various densities and particle sizes of minerals within ores 600. As with most separation devices, optimum stroke, frequency, amplitude, and other factors are determined through trial and error for a given type of ore 600—it's incumbent upon the operator to explore the various options as he or she initiates concentration of heavy material 500 contained ore 600 of a particular composition. As explained above, the length of the downward stroke imparted to central member 50 is adjusted using screw assembly 76 to move adjustable roller 66 along rocker arm 54. Minimum stroke is obtained when adjustable roller 66 is directly underneath rotating cam 68 as shown in FIG. 12 (and FIGS. 15 and 16). Increased stroke is obtained by moving adjustable roller 66 in direction 78 as shown in FIG. 13 (and FIGS. 17 and 18), and further increased stroke is obtained by moving adjustable roller even further in direction 78 as is shown in FIG. 14 (and FIGS. 19 and 20). Diaphragm 52 must be capable of operating within a relatively-wide range of vertical settings. In other words, diaphragm 52 must be capable of withstanding at least a 1 inch stroke of central member 50, which will accommodate a 0.375 inch stroke at high index or a 0.125 inch stroke at low index. This can be accomplished either by, (1) providing a diaphragm 52 which is considerably larger in diameter than the upstanding tube 22, or, preferably (2) utilizing a diaphragm 52 with a built-in fold or depression to add flexibility while limiting effective displacement area as closely as possible to the area of central member 50. In any case, the design should avoid stretching diaphragm 52 which could cause failure. An adjustment objective is to provide a pulse cycle in upstanding tube 22 which is sufficient to suspend all upstanding tube 22 contents, yet not so strong as to produce turbulence.

Referring to FIG. 10, an option to increase the amplitude of rocker arm 54 is to add a flywheel 80 (e.g. 10 lbs) to the shaft 71 which turns rotating cam 68. Flywheel 80 assists motor 70 and rotating cam 68 to maintain a constant speed once set. Adding flywheel 80 will increase rotational inertia to the camshaft and provide increased amplitude to the rocker arm 54 downstroke. Providing a heavier return spring 58 as needed will improve amplitude to the upstroke (refer to FIGS. 3 and 25).

The stroke frequency is adjusted by changing a speed adjuster and/or the throttle lever on variable-speed electric motor 70 (refer to FIGS. 1 and 2).

Figure 15:
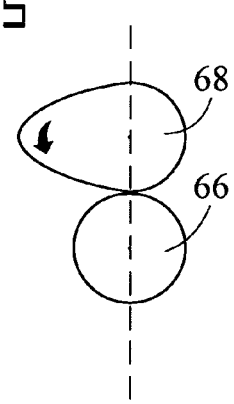
FIG. 15 is an enlarged side elevation view showing a rotating cam and adjustable roller of FIG. 12 with the adjustable roller in its uppermost position.
Figure 16:
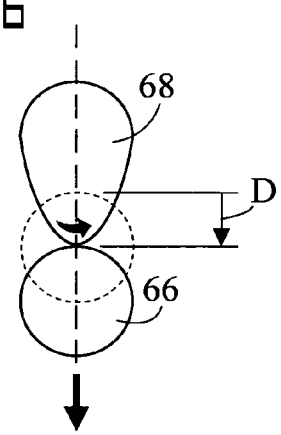
FIG. 16 is an enlarged side elevation view as in FIG. 15 showing the adjustable roller in its lowermost position.

FIG. 15 is an enlarged side elevation view showing rotating cam 68 and adjustable roller 66 of FIG. 12 with adjustable roller 66 in its uppermost position. FIG. 16 is an enlarged side elevation view as in FIG. 15 showing adjustable roller 66 in its lowermost position. Adjustable roller 66 has been adjusted to reside directly under rotating cam 68. The distance D is the distance between the uppermost position of FIG. 15 and the lowermost position of FIG. 16. FIGS. 15 and 16 show the minimum distance described in FIG. 12 which produces the minimum stroke of central member 52.

Figure 17:
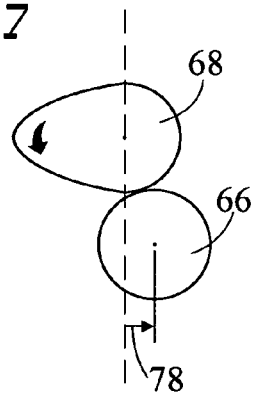
FIG. 17 is an enlarged side elevation view showing a rotating cam and adjustable roller of FIG. 13 with the adjustable roller in its uppermost position.
Figure 18:
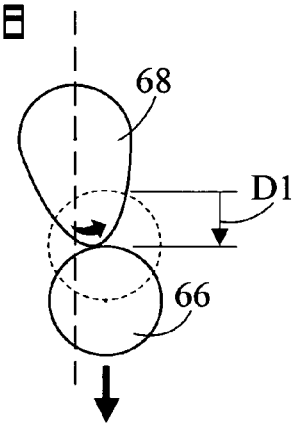
FIG. 18 is an enlarged side elevation view as in FIG. 17 showing the adjustable roller in its lowermost position.

FIG. 17 is an enlarged side elevation view showing rotating cam 68 and adjustable roller 66 of FIG. 13 with adjustable roller 66 in its uppermost position. FIG. 18 is an enlarged side elevation view as in FIG. 17 showing adjustable roller 66 in its lowermost position. Adjustable roller 66 has been moved in direction 78 so that it is no longer directly under rotating cam 68. The distance is now D1 between the uppermost position of FIG. 17 and the lowermost position of FIG. 18, where D1 is greater than D of FIGS. 15 and 16. As such FIGS. 17 and 18 depict the increased distance shown and described in FIG. 13 which produces an increased stroke of central member 52. The reason for the increased distance D1 is that when adjustable roller 66 is horizontally offset from rotating cam 68 (i.e. moved in direction 78), the FIG. 17 uppermost position of adjustable roller 66 is higher than the uppermost position of FIG. 15.

Figure 19:
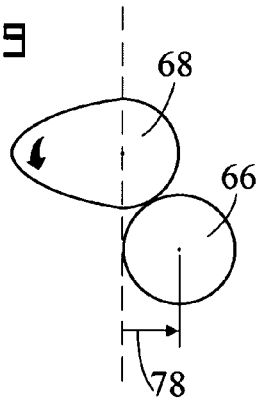
FIG. 19 is an enlarged side elevation view showing a rotating cam and adjustable roller of FIG. 14 with the adjustable roller in its uppermost position.
Figure 20:
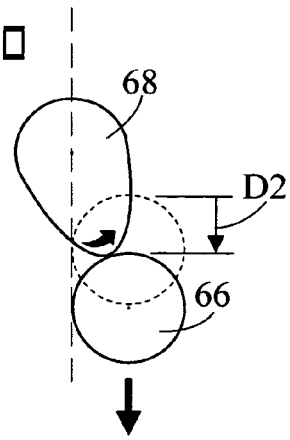
FIG. 20 is an enlarged side elevation view as in FIG. 19 showing the adjustable roller in its lowermost position.

FIG. 19 is an enlarged side elevation view showing rotating cam 68 and adjustable roller 66 of FIG. 14 with adjustable roller 66 in its uppermost position. FIG. 20 is an enlarged side elevation view as in FIG. 19 showing adjustable roller 66 in its lowermost position. Adjustable roller 66 has been moved further (as compared to FIG. 17) in direction 78. The distance is now D2 between the uppermost position of FIG. 19 and the lowermost position of FIG. 20, where D2 is greater than D1 of FIGS. 17 and 18. As such FIGS. 19 and 20 depict the increased distance described in FIG. 14. Again, the reason for the distance increase is that when adjustable roller 66 is horizontally offset from rotating cam 68 (i.e. moved in direction 78), the FIG. 19 uppermost position of adjustable roller 66 is higher than the uppermost position of FIG. 17.

Figure 21:
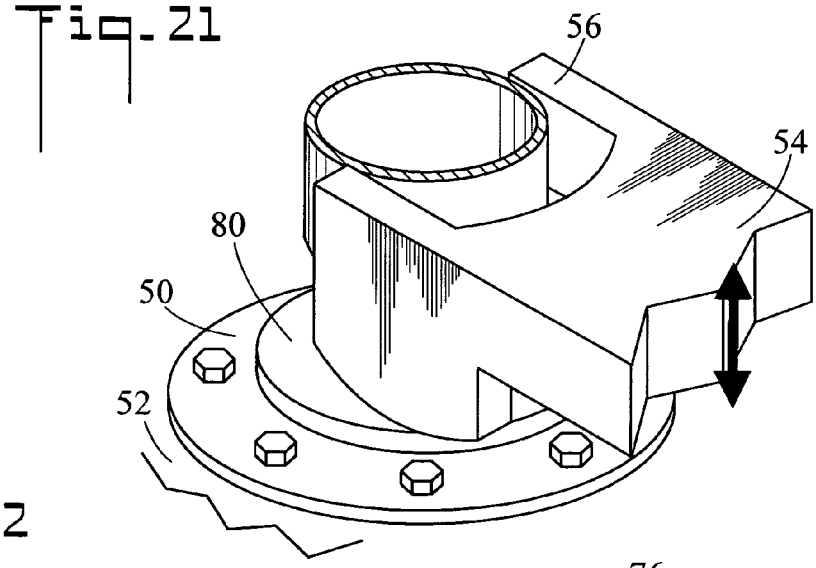
FIG. 21 is an enlarged fragmented perspective view of a portion of the pulsator.

FIG. 21 is an enlarged fragmented perspective view of a portion of pulsator 36. In the shown embodiment, head 56 of rocker arm 54 is a yoke which partially surrounds central member 50. A cushion 80 is disposed on top of central member 50 and reduces the sound created by the downward stroke of head 56 engaging central member 50.

Figure 22:
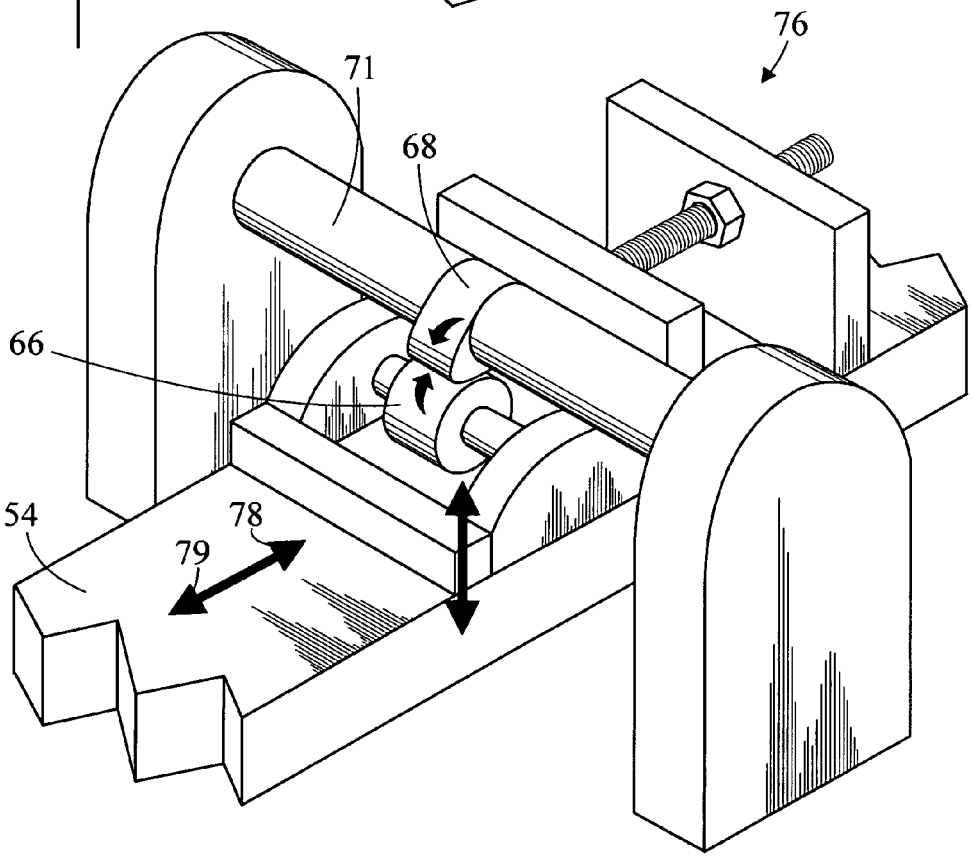
FIG. 22 is an enlarged perspective view of another portion of the pulsator.

FIG. 22 is an enlarged perspective view of another portion of pulsator 36 showing rocker arm 54, adjustable roller 66, rotating cam 68, shaft 71, and screw assembly 76.

Figure 23:
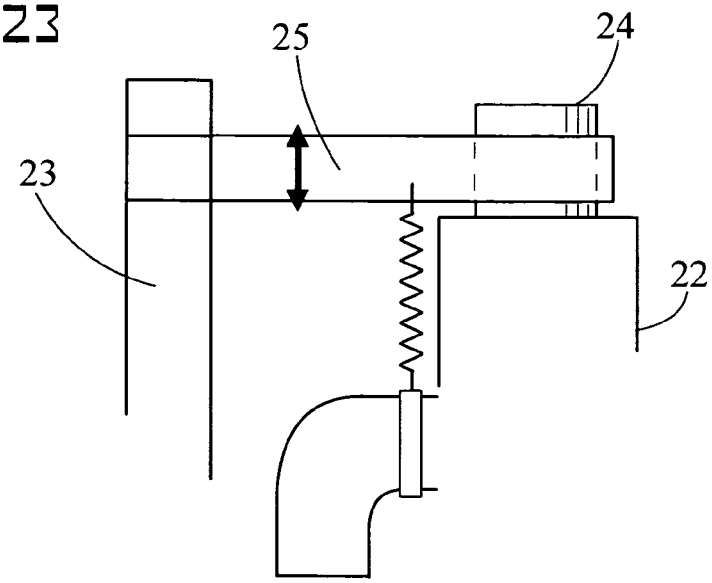
FIG. 23 is an enlarged view of area 23 of FIG. 2.
Figure 24:
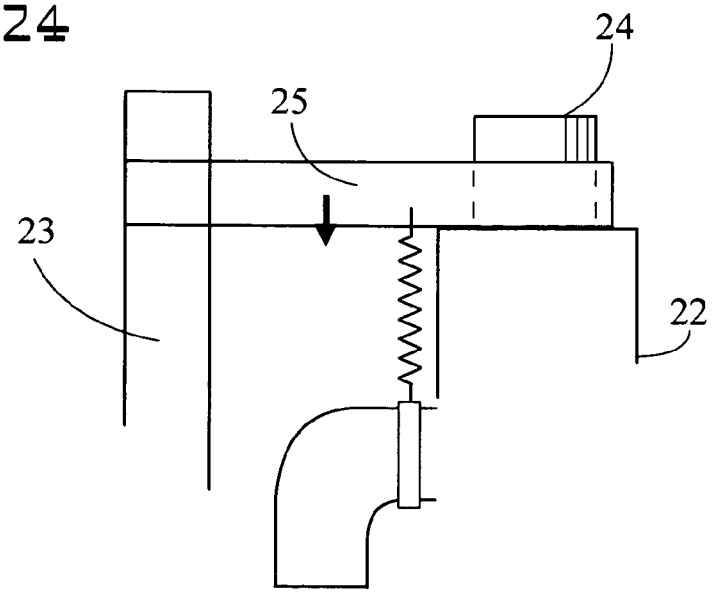
FIG. 24 is an enlarged view as in FIG. 23 showing a stop adjustment.

FIG. 23 is an enlarged view of area 23 of FIG. 2, and FIG. 24 is an enlarged view as in FIG. 23 showing a stop adjustment. Apparatus 20 includes an adjustable stop 25 which stops the upward motion of upstanding tube 22. Adjustable stop 25 in combination with stanchion 23 serves to hold upstanding tube 22 in a vertical orientation. Adjustable stop 25 movably attaches to stanchion 23 and extends laterally to encircle top 24 of upstanding tube 22. Adjustable stop 25 is adjustable upward or downward by loosening a set-bolt, which secures it to stanchion 23, and sliding the adjustable stop 25 in a desired direction and re-tightening set-bolt.

Stanchion 23 and adjustable stop 25 serve to provide and maintain upright alignment of upstanding tube 22, and to limit the vertical distance upstanding tube 22 travels upward on its return following each downward stroke of pulsator 36 (refer to FIGS. 10-15 and the associated discussions). Since changing the stroke length provided by rocker arm 54 changes the at-rest position of upstanding tube 22 (index or normal position), adjustable stop 25 must be adjusted after each stroke adjustment of rocker arm 54.

As previously noted, rocker arm 54 can be adjusted to provide about 0.125 to about 0.375 inches of downward stroke to upstanding column 22. Adjustable stop 25 is used to shorten the column stroke by "wasting" some of rocker arm's 54 current movement. As an example, if the material being run is best-separated by a ⅛ inch actual stroke of upstanding tube 22, rocker arm 54 could be set to provide a ¼ inch maximum stroke and adjustable stop 25 set to let the column return only ⅛ inch; therefore, as we go through a full stroke cycle of the apparatus:

Rocker arm 54 begins its downward travel when activated by rotating cam 68. Since adjustable roller 66 is in constant contact with rotating cam 68, head 56 of rocker arm 54 travels ⅛ inch in thin air prior to engaging cushion 80 (refer to FIG. 21). When head 56 engages cushion 80, it has accelerated from at-rest on the top if its cycle to its maximum downward velocity because at the moment of its contact with cushion 80 it is being driven by the highest rate of lift available on the cam lobe profile. Due to the resulting sudden acceleration imparted to upstanding tube 22, the ore 600 and water 700 mixture within are thrust upward at a greater rate than without the sudden impact, a usually-desirable action to accomplish suspension of those materials. As head 56 continues its downward travel for another ⅛ inch, the ore 600 and water 700 mixture travels upwardly through upstanding tube 22 about ⅜ inch to ⅝ inch, momentarily suspending the ore 600 in the water 700.

At the lowest extent of head 56 and upstanding tub 22 down stroke, head 56 and upstanding tube 22 begin their return to at-rest position at the same rate, dictated by the cam's return-side profile. At the point each has returned upwardly ⅛ inch, upstanding tube 22 collides with adjustable stop 25, thereby limiting the upstanding tube 22 upward return stroke cycle to ⅛ inch. Not so limited, rocker arm 54 continues upwardly for another ⅛ inch leaving a space between head 56 and cushion 80 which the next cycle will close again as the process continues. As upstanding tube 22 returns to rest at the end of each of its cycles, the materials within have further-stratified, at the rate Stokes Law predicts—the heavies have settled, the lighter material has risen. When adjusting rocker arm 54 to change stroke length, adjustable roller 66 is moved horizontally toward or away from rotating cam 68 within the space between rotating cam 68 and pivot 69. This change causes rocker arm 54 to be at rest at a different index position than it was for the prior setting. Since changing the index position also changes the lowermost extent of rocker arm 54 travel, adjustable stop 25 must also be repositioned to limit the upward travel of upstanding tube 22 to the desired column stroke and to usually provide for wasted space between head 56 and cushion 80. FIG. 24 shows adjustable stop 25 being moved downward so as to limit the upward movement of upstanding tube 22 with respect to the position shown in FIG. 23.

FIG. 25 is cross sectional view of the tube showing measurement of ore pulsations. Top end 24 of upstanding tube 22 is open. Apparatus 20 further includes a threaded rod 84 which is shaped and dimensioned to be inserted down from open top end 24 of upstanding tube 22 and into ore and water mixture 600. When so inserted, threaded rod 84 is gripped by the ore 600 and water 700 and senses the mixture's state of suspension. In an embodiment, threaded rod 84 is an 18 inch×⅜ inch rod which is threaded its entire length. The threading provides resistance between rod 84 and ore 600 and water 700, and helps better sense the ore 600 and water 700 motion. Threaded rod 84 is inserted by hand vertically through the opening at the top of upstanding tube 22 down through ore 600 and water 700 and into ragging 60 and 62 (refer to FIG. 8) to screen 38, while apparatus 20 is operating. When proper ore suspension is occurring, the inserted rod 84 will lower to screen 38 with little resistance and a pulsing downward pull can be felt during each return stroke of rocker arm 54 (refer to FIG. 10). With inadequate ore suspension, rod 84 will lower to screen 84 only after several strokes of rocker arm 54. Inadequate suspension may force heavy material 500 (refer to FIG. 8) to discharge through tailing discharge 46 and be lost. Threaded rod 84 supplements the visual observation of ore 600 and water 700 motion through observation window 44 (refer to FIGS. 1, 21 and 22). Though ore 600 may appear to be adequately suspended in water 700 when viewed through observation window 44, it is useful to confirm suspension by checking with threaded rod 84.

Figure 26:
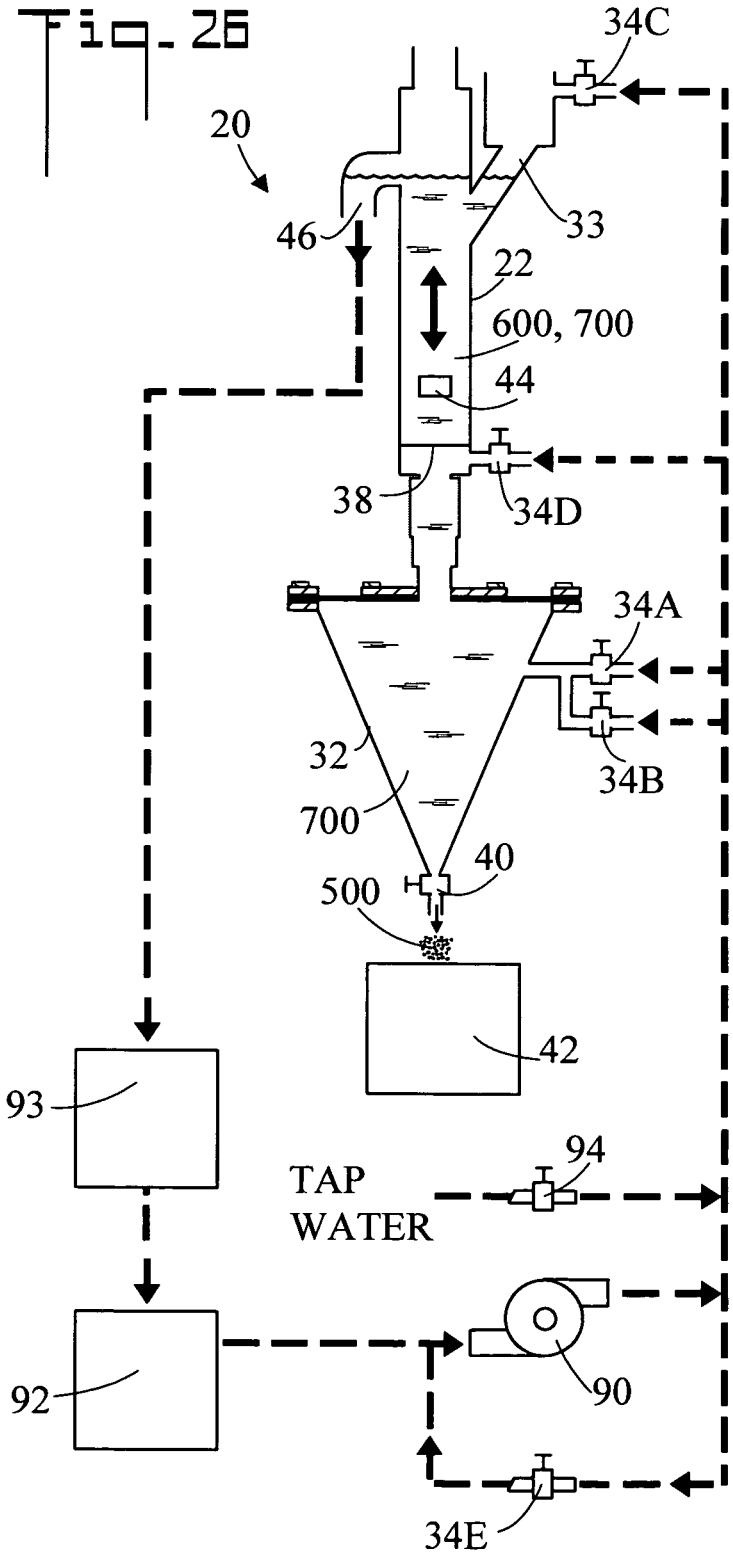
FIG. 26 is a view showing the flow of water within the apparatus.

FIG. 26 is a view showing the flow of water 700 within apparatus 20. Water 700 is supplied at approximately 10 to 45 PSI through a pipe or hose from re-circulating pump 90. Water 700 for pump 90 is drawn from a pump intake tank 92 into which tailing water is collected via a settling tank 93. Alternately, water 700 can be supplied from a tap water outlet 94. A large main valve 34A opens into reservoir 32, and is capable of admitting the full stream of water 700 supplied by pump 90 or tap water outlet 94. The purpose of main valve 34A is to rapidly fill reservoir 32 and upstanding tube 22 at the start of apparatus 20 operation. However, after filling reservoir 32 and upstanding tube 22, main valve 34A is somewhat difficult to finely adjust for optimum water flow during operation. As such, a small water line and trim valve 34B is installed which directs water 700 around main valve 34A. Trim valve 34B permits fine adjustment during operation by setting the larger valve closed or nearly closed and the small valve open sufficiently to supply or trim operational water flow. Main valve 34A and trim valve 34B comprise a water flow control which regulates the turbulence of ore and water mixture 600 within upstanding tube 22.

Two additional small lines and valves are installed in the water line on the pressure side of main valve 34A. The first, feed tube valve 34C supplies water 700 to feed tube 33 via a feed hopper, and is adjusted to facilitate turning the feed stock (ore) into a slurry. The second, flush valve 34D, is used only-occasionally to flush the lower portion of upstanding tube 22 and reservoir 32 of material which may have hung up on the walls of those vessels during operation. Bypass valve 34E bypasses water from the pressure side to the suction side of re-circulating pump 90, acting as a manual relief valve.

During startup water flow is adjusted to result in ore 600 and water 700 pulsating vertically, with little turbulence, within upstanding tube 22. After vertical movement of ore 600 and water 700 stabilizes, threaded rod 84 is slowly inserted down into the open top 24 of upstanding tube 22 through the pulsating slurry until screen 38 is encountered (also refer to FIG. 25 and the associated discussion). If considerable resistance to lowering of rod 84 is encountered, a slight increase in water flow is made by opening the trim valve 34B. Conversely, if little resistance is encountered, there may exist a need to reduce water flow by slightly closing the trim valve 34D and/or main valve 34A. Before reducing the flow through either valve, rod 84 is held suspended within the pulsating ore 600 and water 700 mixture to determine if rod 84 is being pulled downward as the ore 600 and water 700 mixture moves toward reservoir 32 (this happens when upstanding tube 22 moves upward). If the operator detects a significant "grabbing" by ore 600 and water 700 mixture of threaded rod 84 during each stroke and there is only slight turbulence within the mixture (as viewed through observation window 44), the water flow setting is close to or is at optimum and should not be reduced. If considerable turbulence exists or there is little downward pull on threaded rod 84, the water flow should be reduced slightly. The best results are obtained with a water flow which results in a significant downward pull then a detectable upward, suspending influence on threaded rod 84 during each full cycle of rocker arm 34 and upstanding tube 22 with only slight concurrent turbulence. Only through experience will the operator learn the settings conducive to proper concentration—a relatively clean concentrate and few "heavies" lost in the tailings are the goals which drive water adjustment.

Since each ore or material tested is somewhat unique in its components' specific-gravity and size, both stroke and water flow are critical to obtaining good concentration of heavy material 500. Generally stroke is longer, more frequent, and/or water flow is greater as heavy material 500 density or particle size increases. An objective is to seek pulse cycles within upstanding tube 22 which are adequate to suspend all the contents of internal cavity 30 to some degree, yet not so strong as to produce much turbulence or to carry away smaller heavy material 500 through tailing discharge 46.

Heavy material 500 migrates via gravity down through reservoir 32, and is periodically removed via heavy material output valve 40 and container 42. Lighter material exits upstanding tube 22 as tailings in tail water via tailing discharge 46, and is routed to settling tank 93 from which it is removed manually or mechanically from the circuit; tail water flows from settling tank 93 to pump intake tank 92. As such, water 700 is recycled through apparatus 20.

Figure 27:
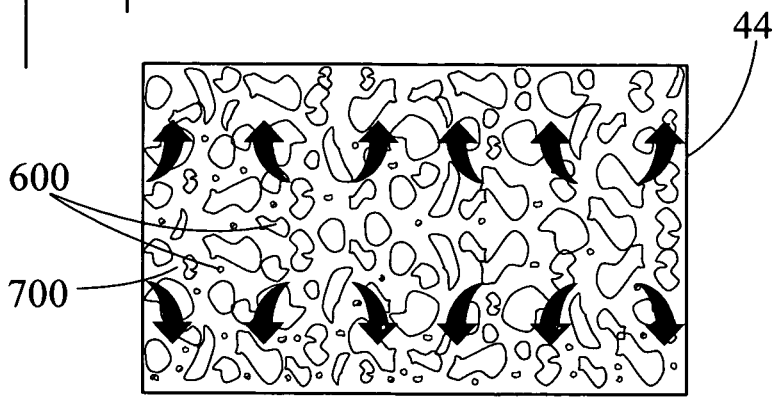
FIG. 27 is an enlarged view through an observation window showing turbulent ore movement; and, FIG. 28 is an enlarged view through the observation window showing desired non-turbulent ore movement.
Figure 28:
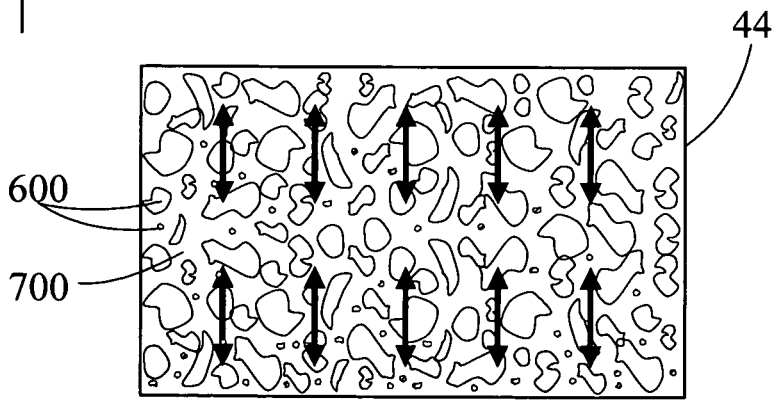

FIG. 27 is an enlarged view through observation window 44 showing turbulent ore movement, and FIG. 28 is an enlarged view through observation window 44 showing desired non-turbulent ore movement. In FIG. 27 during operation of apparatus the movement of ore 600 and water 700 is observed to be turbulent wherein the mixture not only moves up and down, but also moves right and left. Such turbulent motion can cause heavy material 500 to be swept away and discharged as tailings. To prevent this, apparatus 20 is adjusted to produce the desired non-turbulent generally straight up and down movement of FIG. 28. In general turbulence is decreased by (1) decreasing the flow of water, (2) decreasing the length of the downward stroke of rocker arm 54 (refer to FIG. 10), and/or decreasing the stroke frequency by changing the rpm of motor 70.

In terms of use, a method for removing heavy material 500 from ore 600 in a water environment includes: (refer to FIGS. 1-28)

(a) providing ore 600;

(b) providing water 700;

(c) proving an apparatus 20 for removing heavy material 500 from ore 600, the apparatus 20 including;

an upstanding tube 22 having a top end 24, an opposite bottom end 26, a longitudinal axis 28, and an internal cavity 30;

a reservoir 32 disposed beneath upstanding tube 22;

a pulsator 36 connected to bottom end 26 of upstanding tube 22 and to reservoir 32, pulsator 36 causing upstanding tube 22 to cyclically move downward toward reservoir 32 thereby causing ore 600 and water 700 to rise within upstanding tube 22;

pulsator 36 including (1) an outer member 48 connected to reservoir 32, (2) a central member 50 connected to bottom end 26 of upstanding tube 22, central member 50 having an opening 51 which passes water 700 and heavy material 500, and (3) a diaphragm 52 which connects outer member 48 to central member 50, central member 50 and diaphragm 52 movable up and down to create a pulsing action;

pulsator 36 including a stroke adjustment;

(d) placing ore and water within upstanding tube 22, and placing water 700 within reservoir 32;

(e) activating pulsator 36; and, (f) using the stroke adjustment to produce a desired downward motion of central member 50.

The method further including:

in step (c), pulsator 36 including a rocker arm 54 having a head 56 which cyclically forces central member 50 downward into reservoir 32;

rocker arm 54 including in step (c), the stroke adjustment including rocker arm 54 including an adjustable roller 66;

in step (c), a rotating cam 68 which engages adjustable roller 66 on rocker arm 54 and cyclically forces rocker arm 54 downward toward reservoir 32; and, in step (f), moving adjustable roller 66 to produce a desired downward motion of central member 50.

The method further including:

in step (c), upstanding tube 22 including an observation window 44;

after step (f), looking through observation window 44 and observing the motion of ore 600 and water 700;

noting that the motion of ore 600 and water 700 is turbulent; and, using the stroke adjustment to lessen the downward motion of central member 50.

The method further including:

in step (c), top end 24 of upstanding tube 22 being open;

in step (c), a threaded rod 84 which is shaped and dimensioned to be inserted down from open top end 24 of upstanding tube 22 and into ore 600 and water 700;

after step (e), inserting threaded rod 84 into ore 600 and water 700 to measure a state of suspension of ore 600 in water 700.

The method further including:

in step (c), an adjustable stop 25 which stops the upward motion of upstanding tube 22; and, after step (f), using adjustable stop 25 to limit the upward motion of upstanding tube 22 consistent with downward motion of central member 50.

Another method for removing heavy material 500 from ore 600 in a water environment includes:

(a) providing ore 600;

(b) providing water 700;

(c) proving an apparatus 20 for removing heavy material 500 from ore 600, apparatus 20 including;

an upstanding tube 22 having a top end 24, an opposite bottom end 26, a longitudinal axis 28, and an internal cavity 30;

a reservoir 32 disposed beneath upstanding tube 22;

a pulsator 36 connected to bottom end 26 of upstanding tube 22 and to reservoir 32, pulsator 36 causing upstanding tube 22 to cyclically move downward toward reservoir 32 thereby causing ore and water mixture 600 to rise within upstanding tube 22;

pulsator 36 including (1) an outer member 48 connected to reservoir 32, (2) a central member 50 connected to bottom end 26 of upstanding tube 22, central member 50 having an opening 51 which passes water 700 and heavy material 500, and (3) a diaphragm 52 which connects outer member 48 to central member 50, central member 50 and diaphragm 52 movable up and down to create a pulsing action;

a water flow control (34A and 34B) for controlling an amount of water 700 flowing into reservoir 32;

(d) placing ore 600 and water 700 within upstanding tube 22, and placing water 700 within reservoir 32;

(e) activating pulsator 36; and, (f) using water flow control (34A and 34B) to regulate turbulence of ore 600 and water 700 within upstanding tube 22.

The possible embodiments of the apparatus and method of use described herein are exemplary and numerous modifications, combinations, variations, and rearrangements can be readily envisioned to achieve an equivalent result, all of which are intended to be embraced within the scope of the appended claims. Further, nothing in the above-provided discussions of the apparatus and method should be construed as limiting the invention to a particular embodiment or combination of embodiments. The scope of the invention is best defined by the appended claims.

I claim:

1. Apparatus for removing heavy material from ore in a water environment, comprising:

an upstanding tube having a top end, an opposite bottom end, a longitudinal axis, and an internal cavity;

a reservoir disposed beneath said upstanding tube;

the ore and the water disposable within said upstanding tube wherein said internal cavity of said upstanding tube receives the ore and the water, and the water disposable within said reservoir; and, a pulsator connected to said upstanding tube, said pulsator causing said upstanding tube to cyclically move downward toward said reservoir thereby causing the ore and the water to rise within said upstanding tube.

2. The apparatus according to claim 1, further including:

said pulsator including (1) an outer member connected to said reservoir, (2) a central member connected to said bottom end of said upstanding tube, said central member having an opening which passes the water and the heavy material, and (3) a diaphragm which connects said outer member to said central member; and, said central member and said diaphragm movable up and down to create a pulsing action.

3. The apparatus according to claim 2, further including:

said outer member, said central member, and said diaphragm shaped and dimensioned so that a downward vertical movement of said central member and said diaphragm into the water in said reservoir results in a greater upward vertical movement of the ore and the water within said internal cavity of said upstanding tube.

4. The apparatus according to claim 2, further including:

said pulsator including a rocker arm having a head which cyclically forces said central member downward into said reservoir; and, pressure in said reservoir urging said central member and said upstanding tube upward.

5. The apparatus according to claim 4, further including:

said head of said rocker arm being a yoke which partially surrounds said central member.

6. The apparatus according to claim 4, further including:

said rocker arm including an adjustable roller; and, a rotating cam which engages said adjustable roller on said rocker arm and cyclically forces said rocker arm downward toward said reservoir.

7. The apparatus according to claim 2, further including:

said internal cavity of said upstanding tube having a cross sectional area perpendicular to said longitudinal axis;

said opening in said central member having a cross sectional area perpendicular to said longitudinal axis; and, said cross sectional area of said internal cavity being greater than said cross sectional area of said opening in said central member.

8. The apparatus according to claim 2, further including:

said central member having an outer radius RF, and said upstanding tube having an inner radius RT; and, a vertical movement amplification being proportional to RF, and inversely proportional to RT.

9. The apparatus according to claim 1, further including:

an adjustable stop which stops the upward motion of said upstanding tube.

10. The apparatus according to claim 1, further including:

said upstanding tube including an ore feeder and a tailings discharge; and, said ore feeder being disposed below said tailings discharge.

11. The apparatus according to claim 1, further including:

a stanchion for holding said upstanding tube in a vertical orientation; and, a spring connected between said stanchion and said upstanding tube, said spring urging said upstanding tube upward.

12. The apparatus according to claim 1, further including:

a screen disposed across said internal cavity of said upstanding tube, said screen not perpendicular to said longitudinal axis of said upstanding tube.

13. The apparatus according to claim 1, further including:

said top end of said upstanding tube being open; and, a threaded rod which is shaped and dimensioned to be inserted down from said open top end of said upstanding tube and into the ore and the water.

14. The apparatus according to claim 1, further including:

said pulsator including (1) an outer member connected to said reservoir, (2) a central member connected to said bottom end of said upstanding tube, said central member having an opening which passes the water and the heavy material, and (3) a diaphragm which connects said outer member to said central member;

said central member and said diaphragm movable up and down to create a pulsing action;

said outer member, said central member, and said diaphragm shaped and dimensioned so that a downward vertical movement of said central member and said diaphragm into the water in said reservoir results in a greater upward vertical movement of the ore and the water within said internal cavity of said upstanding tube;

said pulsator including a rocker arm having a head which cyclically forces said central member downward into said reservoir;

pressure in said reservoir urging said central member and said upstanding tube upward;

said rocker arm including an adjustable roller;

a rotating cam which engages said adjustable roller on said rocker arm and cyclically forces said rocker arm downward toward said reservoir;

said internal cavity of said upstanding tube having a cross sectional area perpendicular to said longitudinal axis;

said opening in said central member having a cross sectional area perpendicular to said longitudinal axis;

said cross sectional area of said internal cavity being greater than said cross sectional area of said opening in said central member;

said central member having an outer radius RF, and said upstanding tube having an inner radius RT;

a vertical movement amplification being proportional to RF, and inversely proportional to RT;

an adjustable stop which stops the upward motion of said upstanding tube;

said upstanding tube including an ore feeder and a tailings discharge;

said ore feeder being disposed below said tailings discharge;

a stanchion for holding said upstanding tube in a vertical orientation;

a spring connected between said stanchion and said upstanding tube, said spring urging said upstanding tube upward;

said top end of said upstanding tube being open; and, a threaded rod which is shaped and dimensioned to be inserted down from said open top end of said upstanding tube and into the ore and the water.

15. A method for removing heavy material from ore in a water environment; comprising:

(a) providing ore;

(b) providing water;

(c) providing apparatus for removing heavy material from said ore, said apparatus including;

an upstanding tube having a top end, an opposite bottom end, a longitudinal axis, and an internal cavity;

a reservoir disposed beneath said upstanding tube;

a pulsator connected to said upstanding tube, said pulsator causing said upstanding tube to cyclically move downward toward said reservoir thereby causing said ore and said water to rise within said upstanding tube;

said pulsator including a stroke adjustment;

(d) placing said ore and said water within said internal cavity of said upstanding tube, and placing said water within said reservoir;

(e) activating said pulsator; and, (f) using said stroke adjustment to produce a desired downward motion of said upstanding tube.

16. The method of claim 15, further including:

in step (c), said pulsator including (1) an outer member connected to said reservoir, (2) a central member connected to said bottom end of said upstanding tube, said central member having an opening which passes said water and said heavy material, and (3) a diaphragm which connects said outer member to said central member, said central member and said diaphragm movable up and down to create a pulsing action;

in step (c), said pulsator including a rocker arm having a head which cyclically forces said central member downward into said reservoir;

in step (c), said stroke adjustment including said rocker arm including an adjustable roller;

in step (c), a rotating cam which engages said adjustable roller on said rocker arm and cyclically forces said rocker arm downward toward said reservoir; and, in step (f), moving said adjustable roller with respect to said rotating cam to produce a desired downward motion of said central member.

17. The method of claim 15, further including:

in step (c), said pulsator including (1) an outer member connected to said reservoir, (2) a central member connected to said bottom end of said upstanding tube, said central member having an opening which passes said water and said heavy material, and (3) a diaphragm which connects said outer member to said central member, said central member and said diaphragm movable up and down to create a pulsing action;

in step (c), said upstanding tube including an observation window;

after step (e), looking through said observation window and observing the motion of said ore and said water;

noting that said motion of said ore and said water is turbulent; and, using said stroke adjustment to lessen said downward motion of said central member.

18. The method of claim 15, further including:

in step (c), said top end of said upstanding tube being open;

in step (c), a threaded rod which is shaped and dimensioned to be inserted down from said open top end of said upstanding tube and into said ore and said water;

after step (e), inserting said threaded rod into said ore and said water to measure a state of suspension of said ore in said water.

19. The method of claim 15, further including:

in step (c), said pulsator including (1) an outer member connected to said reservoir, (2) a central member connected to said bottom end of said upstanding tube, said central member having an opening which passes said water and said heavy material, and (3) a diaphragm which connects said outer member to said central member, said central member and said diaphragm movable up and down to create a pulsing action;

in step (c), an adjustable stop which stops the upward motion of said upstanding tube; and, after step (f), using said adjustable stop to limit the upward motion of said upstanding tube consistent with said downward motion of said central member.

20. A method for removing heavy material from ore and in a water environment, comprising:

(a) providing ore;

(b) providing water;

(c) proving apparatus for removing heavy material from said ore, said apparatus including;

an upstanding tube having a top end, an opposite bottom end, a longitudinal axis, and an internal cavity;

a reservoir disposed beneath said upstanding tube;

a pulsator connected to said upstanding tube, said pulsator causing said upstanding tube to cyclically move downward toward said reservoir thereby causing said ore and said water to rise within said upstanding tube;

a water flow control for controlling an amount of said water flowing into said reservoir;

(d) placing said ore and said water within said internal cavity of said upstanding tube, and placing said water within said reservoir;

(e) activating said pulsator; and, (f) using said water flow control to regulate turbulence of said ore and said water within said upstanding tube.

21. The method of claim 20, further including:

in step (c), said top end of said upstanding tube being open;

in step (c), a threaded rod which is shaped and dimensioned to be inserted down from said open top end of said upstanding tube and into said ore and said water; and, after step (f), inserting said threaded rod into said ore and said water to measure a state of suspension of said ore in said water.

* * * * *